US006511550B1

(12) United States Patent
Noestheden

(10) Patent No.: US 6,511,550 B1
(45) Date of Patent: Jan. 28, 2003

(54) METHOD FOR CLEANING AND DRYING AN INDUSTRIAL PART

(75) Inventor: Andrew Noestheden, Tecumseh (CA)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/997,739

(22) Filed: Nov. 29, 2001

(51) Int. Cl.[7] ..... B08B 5/04

(52) U.S. Cl. ..... 134/21; 134/33; 134/26

(58) Field of Search ..... 134/21, 26, 33

(56) References Cited

U.S. PATENT DOCUMENTS 6,381,865 B1 * 5/2002 Noesthedent ..... 134/33

* cited by examiner

*Primary Examiner*—Zeinab El-Arini
(74) *Attorney, Agent, or Firm*—Gifford, Krass, Groh, Sprinkle, Anderson & Citkowski, P.C.

(57) ABSTRACT

A method for cleaning and drying industrial parts, such as crankshafts, engine blocks and the like, is disclosed. The part is first washed in a cleaning solution which is typically water based and may contain degreasing agents. Thereafter, the part is spun at a speed and for a time period sufficient to eject most of the water remaining on the part by centripetal force. Thereafter, the part is subjected to a vacuum sufficient to remove substantially all of the remaining solution on the part.

7 Claims, 1 Drawing Sheet

METHOD FOR CLEANING AND DRYING AN INDUSTRIAL PART

BACKGROUND OF THE INVENTION

I. Field of the Invention

The present invention relates to a method for cleaning and drying industrial parts.

II. Description of the Prior Art

In the manufacture of machinery, such as the manufacture of automotive engines, it is necessary to both clean and dry many other parts which form the machine between various manufacturing steps and prior to assembly. Such parts may contain grease, machine shavings, core sand residue and the like which must be removed from the industrial part prior to its assembly. The failure to remove such debris from the industrial parts oftentimes results in damage to the machine after assembly of the machine from the industrial parts. Furthermore, as used in this application, the term "industrial part" means a metallic component that is subsequently assembled into a machine.

Previously, in order to clean the industrial part of debris, the industrial part was subjected to high pressure liquid sprayers which directed a cleaning solution toward the part. After the part was clean, the part was typically positioned in a dunnage container and allowed to dry.

One disadvantage of this previously known method of cleaning and drying the parts, however, is that oftentimes the water or other cleaning solution used to clean the part would pool in areas of the industrial part. This, in turn, resulted in long term drying of the industrial part such that the industrial part would become damaged by oxidation where the industrial part was iron based. Furthermore, it is necessary that the part be completely dry before many manufacturing operations and prior to assembly since any remaining water or cleaning solution remaining on the part may interfere with the proper machining or assembly of the industrial part into the final machine.

SUMMARY OF THE PRESENT INVENTION

The present invention provides a method for cleaning and drying an industrial part which overcomes all of the above-mentioned disadvantages of the previously known methods.

In brief, in the method of the present invention, the part is first washed in a cleaning solution which is preferably water based and may optionally contain degreasing agents. Any conventional means may be used to wash the part, such as subjecting the part to sprayers, submersing the part in a wash chamber, or the like.

After the part is washed, the part is mounted to a spinning fixture. Thereafter, the part is spun at a speed and for a time sufficient to eject most of the cleaning solution remaining on the part from the part by centripetal force. Preferably, the part is spun between ten and ninety seconds and at a speed of 150 to 500 revolutions per minute.

After the spinning operation, the part is then subjected to a vacuum which is sufficient to remove substantially all of any remaining solution on the part. Preferably, the vacuum is greater than 20 inches of mercury and preferably greater than 29 inches of mercury.

BRIEF DESCRIPTION OF THE DRAWING

A better understanding of the present invention will be had upon reference to the drawing which is a flowchart depicting the method of the present invention.

DETAILED DESCRIPTION OF A PREFERRED EMBODIMENT OF THE PRESENT INVENTION

Figure 1:
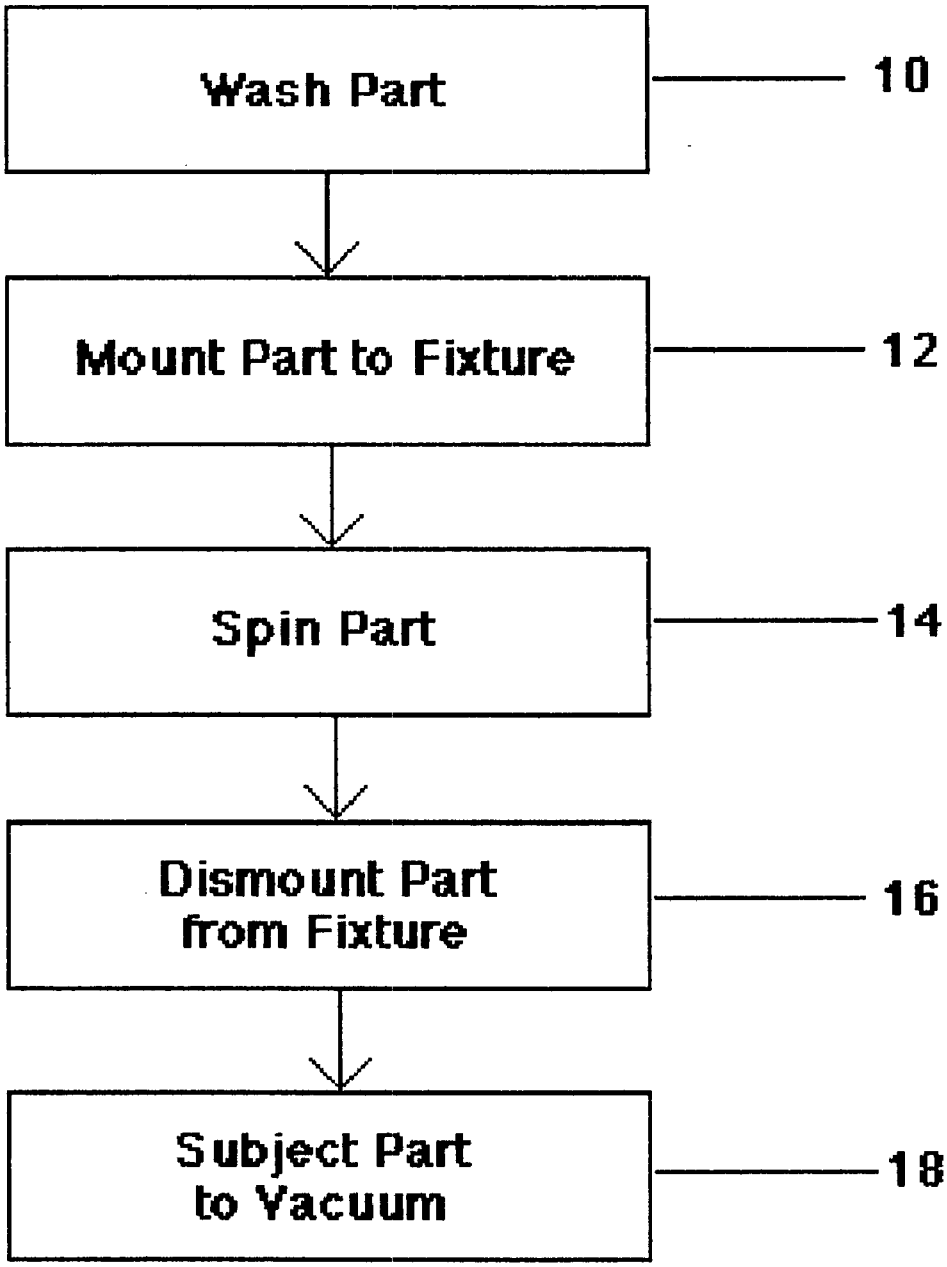

With reference to the drawing, a flowchart illustrating the method of the present invention is shown. At step 10, the part is washed in a cleaning solution which is preferably water based and optionally contains degreasing agents. Any conventional method may be utilized to wash the part such as subjecting the industrial part to high pressure spray of the cleaning solution, immersion of the part within the cleaning solution or the like.

After the washing step 10, the industrial part may contain small pools of the cleaning solution within and/or on the part.

After the part is washed at step 10, the part is then mounted to a spinning fixture at step 12. The actual spinning fixture will vary, of course, depending on the type of part being processed. Preferably, however, the spinning fixture is designed so that the part may be rotated substantially about its center of gravity.

After mounting the part on the spinning fixture at step 12, the part is then spun or rotatably driven at a speed and for a time sufficient to eject most of the cleaning solution remaining on the part by centripetal force at step 14. The amount of time will vary depending upon the type, complexity and structure of the industrial part. However, in practice, the part is spun between ten and ninety seconds.

Likewise, the rotational speed that the part is spun at step 14 will also vary depending upon the type, complexity and configuration of the part. In practice, however, the part is preferably spun at a rate of 150 to 500 revolutions per minute.

After the part has been spun dry at step 14, the part is removed from the spinning fixture at step 16. After removal of the part from the fixture at step 16, the part is then subjected to a vacuum at step 18 which is sufficient to remove substantially all of the remaining cleaning solution on the part. In practice, the vacuum at step 18 is preferably greater than 20 inches of mercury and more preferably greater than 29 inches of mercury. The vacuum imposed on the part at step 18, of course, lowers the boiling point of the cleaning solution so that the cleaning solution boils from the part at room temperature.

From the foregoing, it can be seen that the present invention provides a simple and yet effective means for cleaning and drying industrial parts. Having described my invention, however, many modifications thereto will become apparent to those skilled in the art to which it pertains without deviation from the spirit of the invention as defined by the scope of the appended claims.

I claim:

1. A method for cleaning and drying an industrial part comprising the steps of:

washing the part in a cleaning solution;

thereafter mounting said part to a spinning fixture, spinning the part at a speed and for a time period sufficient to eject most of the cleaning solution remaining on the part from the part by centripetal force; and thereafter subjecting the part to a vacuum sufficient to remove all of any remaining cleaning solution on the part.

2. The method as defined in claim 1 wherein said time period is between ten and ninety seconds.

3. The method as defined in claim 1 wherein said speed is between 150 and 500 revolutions per minute.

4. The method as defined in claim 1 wherein said vacuum is greater than 20 inches of mercury.

5. The method as defined in claim 4 wherein said vacuum is greater than 29 inches of mercury.

6. The method as defined in claim 1 wherein said cleaning solution is a water-based solution.

7. The method as defined in claim 1 further comprising the step of dismounting said part from said spinning fixture after said spinning step and prior to said vacuum step.

* * * * *